US009190742B2

(12) United States Patent
Gunreben et al.

(10) Patent No.: US 9,190,742 B2
(45) Date of Patent: Nov. 17, 2015

(54) CONNECTOR ASSEMBLY WITH SAFETY SPRING BAR

(75) Inventors: Michael Gunreben, Schwanstetten (DE); Frank Odorfer, Rothenbach an der Pegnitz (DE)

(73) Assignee: Delphi International Operations Luxembourg, Luxembourg (LU)

( * ) Notice: Subject to any disclaimer, the term of this patent is extended or adjusted under 35 U.S.C. 154(b) by 184 days.

(21) Appl. No.: 13/882,270

(22) PCT Filed: Oct. 17, 2011

(86) PCT No.: PCT/EP2011/068100

§ 371 (c)(1),
(2), (4) Date: May 29, 2013

(87) PCT Pub. No.: WO2012/055719

PCT Pub. Date: May 3, 2012

(65) Prior Publication Data

US 2013/0252455 A1 Sep. 26, 2013

(30) Foreign Application Priority Data

Oct. 29, 2010 (WO) ..... IB/2010/003233

(51) Int. Cl.

| | |
|---|---|
| ***H01R 13/627*** | (2006.01) |
| ***H01R 13/639*** | (2006.01) |
| ***H01R 4/48*** | (2006.01) |
| ***H01R 13/641*** | (2006.01) |

(52) U.S. Cl.

CPC ..... *H01R 4/48* (2013.01); *H01R 13/6277* (2013.01); *H01R 13/639* (2013.01); *H01R 13/641* (2013.01); *H01R 13/6273* (2013.01); *H01R 2201/26* (2013.01)

(58) Field of Classification Search

CPC .. H01R 13/639; H01R 13/6467; H01R 13/62; H01R 13/62938; H01R 62/639; H01R 62/635; H01R 62/64; H01R 62/627; H01R 62/6273; H01R 4/48; H01R 4/52; H01R 33/97; H01R 12/70

USPC ..... 439/370, 357, 489, 641, 152, 153, 155, 439/157, 159, 160, 296, 298, 299, 352

See application file for complete search history.

(56) References Cited

U.S. PATENT DOCUMENTS 5,863,214 A * 1/1999 Hanak ..... 439/352
6,123,575 A 9/2000 Huang et al.

(Continued)

FOREIGN PATENT DOCUMENTS

DE 10032234 A1 1/2002
EP 1124291 A2 8/2001

OTHER PUBLICATIONS

International Search Report dated Dec. 22, 2011.

*Primary Examiner* — Amy Cohen Johnson
*Assistant Examiner* — Milagros Jeancharles
(74) *Attorney, Agent, or Firm* — Robert J. Myers

(57) ABSTRACT

A connector assembly comprising a connector housing, a secondary locking member and a safety spring bar, whereby the secondary locking member and the safety spring bar are assigned to the connector housing. The secondary locking member is movable between a first and a second position, whereby the safety spring bar is adapted to lock the secondary locking member in its second position. The secondary locking member comprises a deflection surface adapted to engage the safety spring bar when the secondary locking member is moved in an insertion direction. Thereby, upon movement of the secondary locking member, the safety spring bar is deflected essentially in the insertion direction, urging the secondary locking member towards its first position. When the secondary locking member is placed in the second position, the safety spring bar is adapted to snap into a safety position, to lock the secondary locking member in its second position.

13 Claims, 3 Drawing Sheets

(56) References Cited

U.S. PATENT DOCUMENTS

| | | | | |
|---|---|---|---|---|
| 6,142,799 | A | 11/2000 | Marcel | |
| 6,328,589 | B1 * | 12/2001 | Annecke | 439/352 |
| 6,419,510 | B2 * | 7/2002 | Shiraki et al. | 439/188 |
| 7,997,914 | B2 * | 8/2011 | Bychkov et al. | 439/159 |
| 8,016,606 | B1 * | 9/2011 | Kwan et al. | 439/352 |
| 2004/0127087 | A1 | 7/2004 | Hirschmann | |
| 2006/0154510 | A1 * | 7/2006 | Annecke | 439/352 |

* cited by examiner

CONNECTOR ASSEMBLY WITH SAFETY SPRING BAR

CROSS-REFERENCE TO RELATED APPLICATION

This application is a national stage application under 35 U.S.C. §371 of PCT Application Number PCT/EP2011/068100 having an international filing date of Oct. 17, 2011, which designated the United States, which PCT application claimed the benefit of PCT Application Number PCT/IB2010/003233, filed Oct. 29, 2010, the entire disclosure of each of which are hereby incorporated herein by reference.

TECHNICAL FIELD OF THE INVENTION

The present invention relates to a connector assembly comprising a secondary locking member and a safety spring bar which preferably provides a go/no go function for the secondary locking member.

BACKGROUND OF THE INVENTION

In many applications, the save coupling of connectors is of high importance. For example, in the case of car safety systems, as e.g. airbag systems in passenger cars, the connectors used for the connection of an airbag to its ignition base have to be provided with reliable safety systems. To ensure that the connectors cannot become loose unintentionally, secondary locking members are used to guarantee the save mechanical coupling.

An example of a connector with a secondary locking member is described in the WO 97/41623 A1. This document describes a connector which can be mated with a corresponding counter connector being part of an airbag ignition mechanism. In assembled condition, when the connector is mated with the corresponding counter connector, it is fixed to the counter connector by means of flexible latching arms. During mating of the connectors, these arms are deflected and snap back into corresponding latching clearances of the counter connector, when fully mated. For securing the mechanical coupling of the connectors, the WO'623 suggests a secondary locking member which can be inserted into the connector when the two connectors are mated. The secondary locking member comprises locking arms, which upon insertion of the secondary locking member move between faces of the counter connector housing and the latching arms of the connector. Once the locking arms are inserted, they inhibit bending of the latching arms. Thus, the latching arms cannot bend out of the latching clearances and the mechanical coupling of the connectors is secure. The secondary locking member described in WO'623 is further provided with locking means to fix the secondary locking member in its locking position, which is the above described position in which it secures the connector mating. However, in the case described in the WO'623, it is possible to place the secondary locking member in a half-fitting position, in which it may not function properly and in which it is not fixed to the connector, and therefore can be removed unintentionally.

A further development of a secondary locking member is disclosed in the co-owned patent application DE 100 05 858 A1. This document discloses a connector with a secondary locking device and a safety spring element, which serves to hold the secondary locking member in a pre-locked position, in which the secondary locking member is mounted to the connector housing but does not hinder mating or unmating of the connector with a corresponding counter connector. The safety spring element described in the DE'858 further provides a so-called go/no go function for the secondary locking member: In the pre-locked position of the secondary locking member, two spring arms of the safety spring element are in contact with stop shoulders of the secondary locking member, thereby preventing a movement of the secondary locking member in direction towards its locking position. Upon mounting of the connector to a corresponding counter connector, the counter connector housing comes into contact with a releasing portion of the connector housing, thereby pressing this releasing portion against the safety spring element. By this pressing action, the safety spring element is deformed and the two spring arms are freed from the stop shoulders of the secondary locking member. Upon consequent moving of the secondary locking member towards its locking position, each spring arm is guided by an inclined channel of the secondary locking member, thereby being bent and biased against the edge of this inclined channel. Shortly before the secondary locking member is placed in its locking position, each spring arm passes a turning point of the inclined channel and snaps into a notch of the secondary locking member, thereby fixing the secondary locking member in its locking position. As long as the secondary locking member is not placed in this locking position, the spring arms are biased against the edges of the inclined channel, and due to the resulting restoring spring force they inhibit the secondary locking member to be placed in a half-fitting position unintentionally: i.e. the spring force causes the secondary locking member to move back into its pre-locked position. The safety spring element thereby provides a go/no go mechanism for the secondary locking member, which assures that the secondary locking member is either placed correctly in its locking position or is moved back into its pre-locked position, but prevents any intermediate position.

It is an object of the present invention to improve the state of the art by providing a connector assembly with an improved secondary locking mechanism. It is in particular an object of the present invention to provide a connector assembly with a secondary locking member which is provided with an improved and more reliable go/no go mechanism, which does not become non-serviceable, e.g. due to fatigue damage of spring components. It is an even further object of the present invention to accomplish said tasks by providing an inexpensive and non-complex secondary locking member, which preferably can be produced as an injection molded part. These and other objects which become apparent upon reading the following description are solved by a connector assembly according to claim 1.

BRIEF SUMMARY OF THE INVENTION

According to the invention, a connector assembly is provided comprising a connector housing, a secondary locking member and at least one safety spring bar, whereby the secondary locking member and the safety spring bar are assigned to the connector housing. The secondary locking member is movable between a first and a second position and when placed in its second position, it serves to secure the mating of the connector assembly in the case that the connector assembly is mated to a corresponding counter connector. The second position is thus the locking position of the secondary locking member. Preferably, the first position of the secondary locking member is a pre-locked position, in which the secondary locking member is fixed by the safety spring bar such that the secondary locking member cannot become loose unintentionally or moved unintentionally into the second position.

According to the invention, the secondary locking member comprises at least one deflection surface and when moved from its first position towards its second position, i.e. in insertion direction, this deflection surface engages the safety spring bar. Preferably, the deflection surface is integrally formed with the secondary locking member but it may also be a separate or intermediate part assigned to the secondary locking member. The safety spring bar can be already in engagement, i.e. for example in direct contact with the deflection surface, when the secondary locking member is placed in its first position, or it can come into contact with the deflection surface only when the secondary locking member is moved in insertion direction. However, according to the invention, upon movement of the secondary locking member in insertion direction, the engagement causes the safety spring bar to be deflected essentially in insertion direction. According to the invention, when the secondary locking member is placed in its second position, the deflected safety spring bar snaps into a safety position, in which it locks the secondary locking member.

Due to said deflection, the safety spring bar provides a counter force and urges the secondary locking member towards its first position. For example, when the secondary locking member is moved in insertion direction, thereby engaging directly or indirectly the safety spring bar, it bends the safety spring bar in insertion direction and due to the spring bar's elasticity, a restoring spring force builds up, which counteracts the secondary locking member's movement. Such a restoring spring force urges the secondary locking member to move back towards its first position, if it is not e.g. manually pressed into said second position. Preferably, the connector housing comprises at least one releasing portion, which can for example be positioned such that upon the aforementioned bending of the safety spring bar, it comes into contact with the bent safety spring bar. Thereby, in a preferred embodiment, it releases the engagement between the safety spring bar and the deflection surface of the secondary locking member. Preferably, this releasing portion is placed such that it releases the engagement shortly before the secondary locking member is placed in its second position. Preferably, the releasing portion is integrally formed with the connector housing, but it may also be a separate or intermediate part assigned to the connector housing.

In a preferred embodiment, in order to release the engagement of the safety spring bar with the deflection surface, for example upon bending of the safety spring bar, the releasing portion deviates the safety spring bar such that the safety spring bar is moved for example sideways, which means in a direction at an angle or even perpendicular to the insertion direction. This sideways motion of the safety spring bar causes the spring bar to be displaced with respect to the deflection surface, such that it slides out of contact with the deflection surface of the secondary locking member. Being no longer engaged by the deflection surface, the safety spring bar snaps back in a direction opposing the insertion direction into the safety position, thereby locking the secondary locking member in its second position. This safety position can exemplarily be provided by a notch or a recess in a face of the secondary locking member or by a stop shoulder extending from the secondary locking member.

In a preferred embodiment, the safety spring bar provides a go/no go mechanism for the secondary locking member. A go/no go mechanism in the sense of the present invention preferably is a mechanism which provides the following: When the secondary locking member is moved in insertion direction, it is urged by the counteracting spring force of the safety spring bar essentially in a direction opposing its insertion direction. After the secondary locking member is moved, e.g. by manually pressing, beyond a releasing point, the secondary locking member is no longer urged towards its first position but preferably towards its second position. This go/no go mechanism provides the advantage that the secondary locking member can neither be placed unintentionally in an intermediate half-fitting position between its first and second position, in which it might not function properly, nor unintentionally in its second position. The inventive construction allows that, when the safety spring bar is placed in its safety position, no spring component is under tension; whereby it is assured that no spring component becomes non-serviceable due to fatigue damage.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
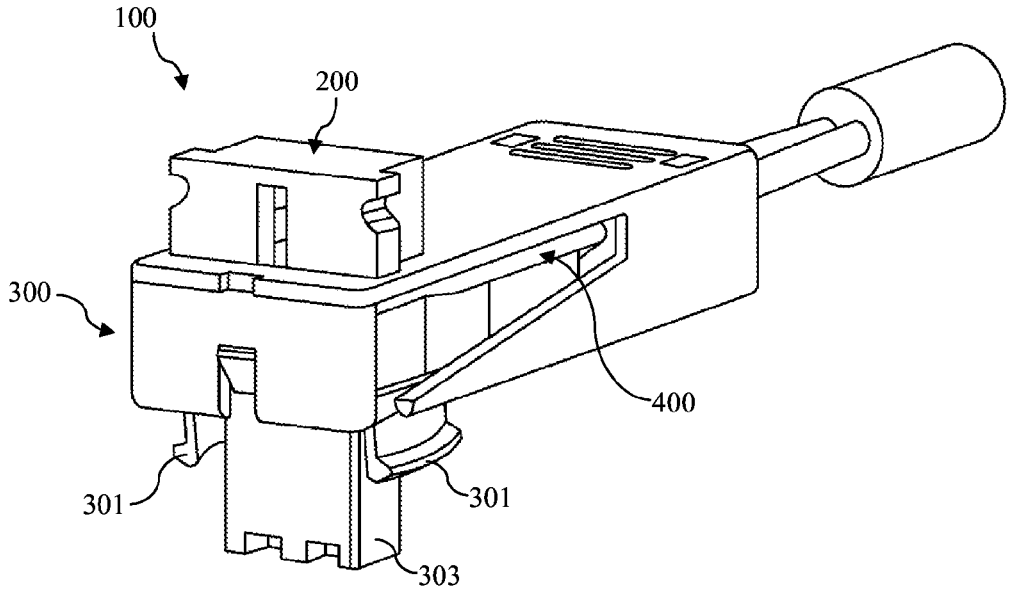
FIG. 1 shows a schematic perspective illustration of the a preferred embodiment in accordance with the invention.

FIG. 1 shows a preferred embodiment of a connector assembly 100 according to the invention with a secondary locking member 200 mounted to a connector housing 300, and a safety spring bar 400 mounted inside the connector housing 300. In FIG. 1, the secondary locking member 200 is shown in its first position. The connector housing 300 comprises two latching arms 301 to fix the connector assembly 100 inside of a corresponding counter connector (not shown) and a connection portion 303 for establishing an electrical connection with the counter connector.

Figure 2:
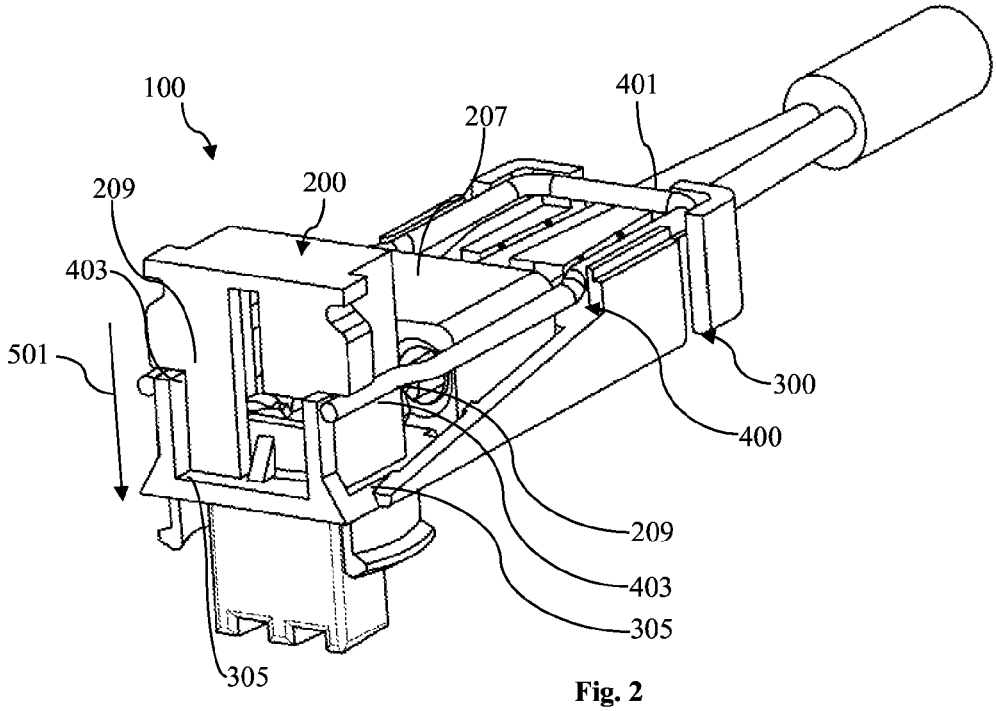
FIG. 2 shows a schematic illustration of the connector assembly of FIG. 1 whereby parts of the figure are cut to show the interior components of the connector assembly.
Figure 4:
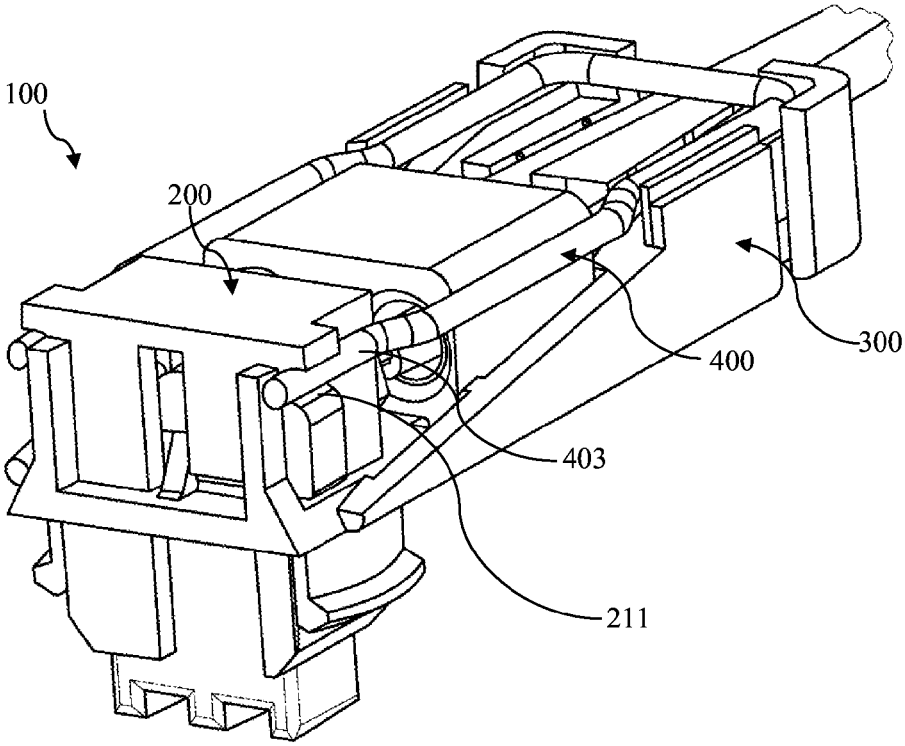
FIG. 4 shows the inventive connector assembly of FIGS. 1 to 3, whereby the secondary locking member is placed in its second position.
Figure 5:
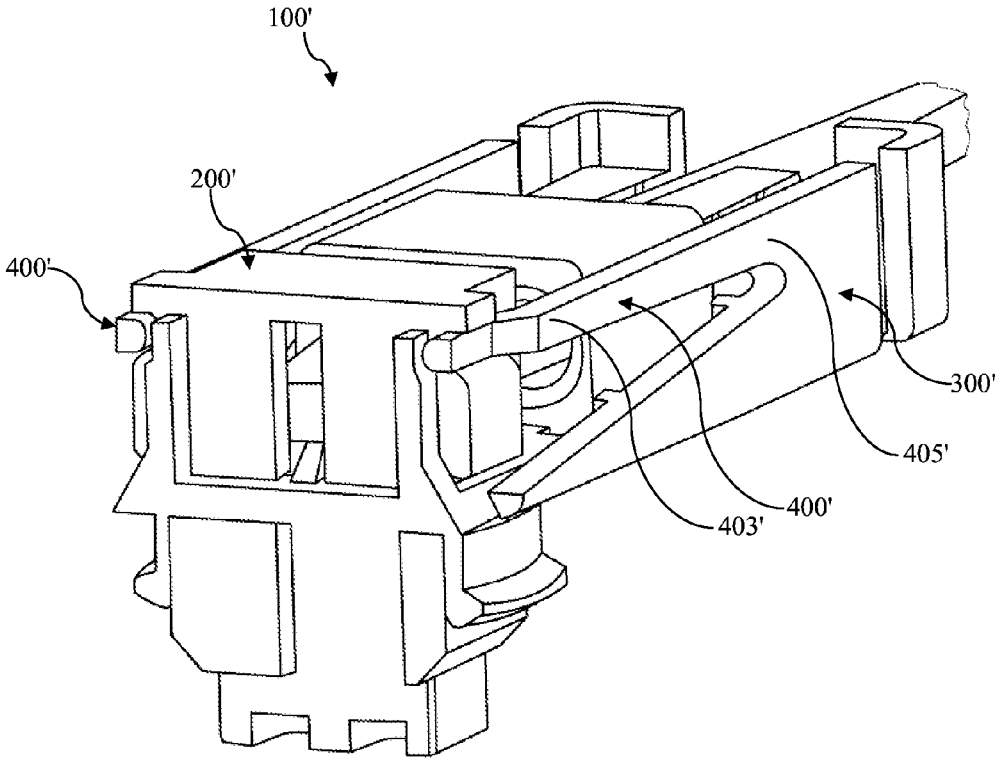
FIG. 5 shows and alternative embodiment of the inventive connector assembly.

FIG. 2 shows the connector assembly 100 of FIG. 1, whereby parts of the connector housing 300 are cut such that interior components of the connector assembly 100 are visible. As one can see in this figure, in this embodiment of the invention, the safety spring bar 400 is an essentially U-shaped wire which extends within a plane essentially perpendicular to the insertion direction of the secondary locking member 200. A base 401 of the legs of the U-shaped wire is fixedly mounted to the connector housing 300 and two free ends 403 of the U are free to move in directions essentially parallel to the insertion direction and sideways to the insertion direction of the secondary locking member 200. This insertion direction of the secondary locking member 200 is indicated by arrow 501 and is the direction of movement of the secondary locking member 200 from its first position (as shown in FIGS. 1 and 2) towards its second position (as shown in FIGS. 4 and 5). As the skilled person will understand, since in principle the free ends 403 are movable or bendable in any direction (as long as they are not blocked by other components), the term "sideways to the insertion direction" in the context of the present application refers to any direction which is not parallel to arrow 501. In FIG. 2, the secondary locking member 200 is shown in its first position, which preferably is a pre-locked position, in which it is fixed such that it cannot unintentionally become loose, or unintentionally be moved into its second position. For this purpose, the safety spring bar 400 is preferably biased against surfaces 207 (only one is visible due to the perspective of the figure) of the secondary locking member 200, thereby holding the secondary locking member 200 in this first position. Alternatively, the secondary locking member 200 can also be fixed in its first position by further latching means.

Figure 3:
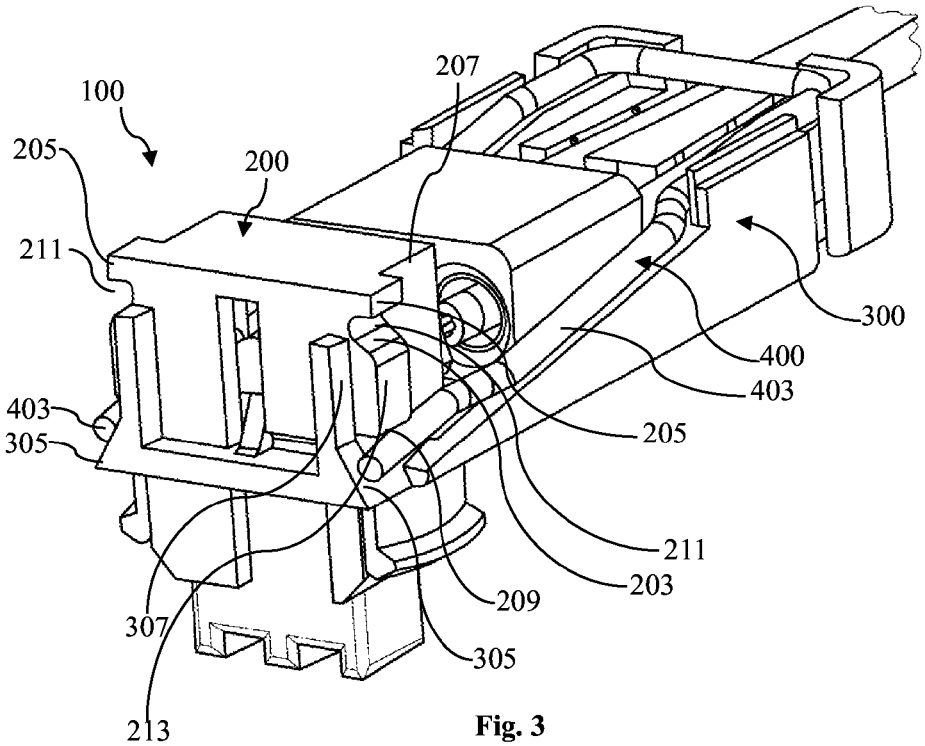
FIG. 3 shows the inventive connector assembly of FIGS. 1 and 2 whereby the secondary locking member is shown shortly before being moved into its second position.

As one can see further from FIG. 2, when the secondary locking member 200 is placed in its first position, deflection surfaces 209 are in engagement with the free ends 403 of the safety spring bar 400. As shown in FIG. 3, due to this engagement, when the secondary locking member 200 is moved in insertion direction, the deflection surfaces 209 bend the free ends 403 of the safety spring bar in insertion direction. It should be noted that in FIG. 3, the secondary locking member 200 is shown in a position shortly before it is placed in its second position. As it is clear to the skilled person, bending of the free ends 403 as shown in the figure results in tension of these free ends 403 causing a restoring spring force to build up which acts against the movement of the secondary locking member 200. Therefore, in this bent position, the free ends 403 urge the secondary locking member 200 back towards its first position, whereby a first part of the go/no go mechanism is realized. When the secondary locking member 200 is moved only partially towards its second position, it will be urged back towards its first position by the free ends 403.

As one can derive from FIG. 3, upon being deflected by the secondary locking member 200 in insertion direction, the ends 403 of the safety spring bar 400 move along the surfaces 207 (only one surface is visible due to the perspective of the figure) of the secondary locking member 200 as well as along a guiding face 307 of the connector housing 300. Upon moving along the guiding face 307, the free ends 403 come into contact with releasing portions 305 of the connector housing 300, which in the shown figure have the form of slopes 305. As one can derive from the figure, a movement of the free ends 403 along these slopes 305 causes a sideway disposition of the free ends 403, which in the figure move the ends 403 in directions away from the connector housing 300. In FIG. 3, the free ends 403 are already disposed to a certain extent and therefore no longer in full engagement with the deflection surfaces 209. As the skilled person will understand, upon continuation of the movement of the secondary locking member 200 in insertion direction, the ends 403 will eventually be freed out of engagement with this deflection surface 209. After being freed out of engagement with the deflection surfaces 209, due to the accumulated restoring spring force, the ends 403 spring back in a direction opposing the insertion direction, along surfaces 213 and along beveled edges 203 (only one edge is visible due to the perspective of the figure) and latch into notches 211, where they are fixed by stop shoulders 205. When the free ends 403 move along the beveled edges 203, the free ends 403 press against these beveled edges 203, thereby supporting the downwards movement of the secondary locking member 200 in its insertion direction. Thus, after the safety spring element 400 and the deflection surface 209 are no longer engaged, a second part of the go/no go mechanism is realized: The secondary locking member 200 is no longer urged towards its first position but rather towards its second position. Thereby it is assured that the secondary locking member 200 is moved completely into its second position.

FIG. 4 shows the secondary locking member 200 being moved completely into its second position and the safety spring bar 400 placed in its safety position, in which position the ends 403 are placed in the notches 211. As one can derive from FIG. 4, placed in this safety position, the ends 403 fix the secondary locking member 200 in its second position. To move the secondary locking member 200 back towards its first position, the free ends 403 have to move along the beveled edges 203, i.e. they have to be deviated away from the connector housing 300. Therefore, in this position, the secondary locking member 200 cannot be removed unintentionally, but the shape of the beveled edge 203 facilitates manually removing the secondary locking member 200 by an operator. It should be noted, that when the safety spring bar 400 is placed in its safety position, none of its components is under tension. Thereby it is assured that none of its spring components become non-serviceable due to fatigue damage.

Due to the inventive interaction of the secondary locking member 200 and the safety spring bar 400, an advantageous go/no go mechanism is provided. When the secondary locking member 200 is placed in a half-fitting intermediate position in between its first and its second position, due to the accumulated restoring spring force, the safety spring bar 400 urges the secondary locking member 200 either in its first position or its second position. When the secondary locking member 200 is placed in its second position, the free ends 403 of the safety spring bar 400 snap into their safety positions, i.e. into notches 211, thereby fixing the secondary locking member 200 in its second position.

FIG. 5 shows an alternative embodiment of the connector assembly 100', whereby the secondary locking member 200' is mounted to the connector housing 300' in its second position. In this embodiment, connector assembly 100' is provided with two safety spring bars 400', each formed as an integral part of the connector housing 300' and being arranged symmetrically thereon. This embodiment has the advantage that the connector housing 300' and the safety spring bar 400' can be formed as a single injection-molded part. As one can see in this figure, each safety spring bar 400' is fixedly connected to the connector housing 300' at its fixed end 405', while its free end 403' is free to move in directions essentially parallel to the insertion direction of the secondary locking member 200' and sideways to the insertion direction. As one can further see, both safety spring bars 400' extend essentially in a common plane which is perpendicular to the insertion direction of the secondary locking member 200'. However, this feature, which is common to both safety spring bars 400 and 400' described herein, is not strictly necessary for all embodiments of the invention. This feature is meant to describe a general orientation of the safety spring bars 400, 400' which does not limit safety spring bars according to the invention to be for example at small angles with respect to said plane or to be at angles with respect to each other. This general orientation is a result of the non-complex construction of the safety spring bar which assures a reliable spring mechanism. Components of safety spring bars such as additional hooking parts or latching elements may protrude out of this plane.

The invention claimed is:

1. A connector assembly comprising:

a connector housing defining a connection portion configured to establish an electrical connection with a corresponding counter connector;

a primary locking member defining a latching arm configured to fix the connector housing within the counter connector;

a secondary locking member moveably attached to the connector housing and is movable between a first and a second position; and a safety spring bar, wherein the safety spring bar is mounted to the connector housing and is configured to lock the secondary locking member intermediate the latching arm and the connection portion in its second position, wherein the secondary locking member defines a deflection surface configured to engage a free end of the safety spring bar when the secondary locking member is moved in an insertion direction from the first position towards the second position, wherein the free end remains engaged with the deflection surface until the secondary locking member reaches the second position, whereupon the free ends are deflected out of engagement with the reflection surface by a sloped releasing portion defined by the connector housing and snap into a safety position, to lock the secondary locking member in the second position.

2. The connector assembly according to claim 1, wherein the safety spring bar is arranged on the connector housing essentially within a plane perpendicular to the insertion direction.

3. The connector assembly according to claim 1, wherein the releasing portion is configured to cause a sideways motion of the safety spring bar upon deflection of the safety spring bar, to release the engagement between the safety spring bar and the deflection surface.

4. The connector assembly according to claim 3, wherein the secondary locking member comprises a beveled surface and upon snapping into the safety position, the safety spring bar is configured to move along the beveled surface, thereby forcing the secondary locking member in the insertion direction.

5. The connector assembly according to claim 4, wherein the free end is movable in one direction essentially parallel to the insertion direction and in one direction sideways to the insertion direction.

6. The connector assembly according to claim 5, wherein the safety spring bar is biased against a surface of the secondary locking member when the secondary locking member is placed in the first position.

7. The connector assembly according to claim 6, wherein the safety spring bar is further configured to lock the secondary locking member in the first position.

8. The connector assembly according to claim 7, wherein the safety spring bar provides a go/no go mechanism for the secondary locking member, urging the secondary locking member to move essentially in a direction opposing the insertion direction when the secondary locking member is not placed in the second position.

9. The connector assembly according to claim 8, wherein the secondary locking member comprises a notch which is configured to receive the safety spring bar when the safety spring bar snaps into the safety position, whereby preferably one side of the notch comprises the beveled surface and one side of the notch comprises a stop shoulder to hold the safety spring bar in the safety position.

10. The connector assembly according to claim 9, wherein the beveled surface is configured to move the safety spring bar sideways to the insertion direction, when the secondary locking member is moved from the second position towards the first position.

11. The connector assembly according to claim 10, wherein the safety spring bar is an essentially U-shaped wire, whereby the base of the U-shaped wire is fixedly mounted to the connector housing and the two free ends of the legs of the U-shaped wire are free to move in directions essentially parallel to the insertion direction and sideways to the insertion direction.

12. The connector assembly according to claim 10, wherein the safety spring bar is formed as an integral part of the connector housing and of the same material as the connector housing.

13. The connector assembly according to claim 10, wherein the safety spring bar is formed as an integral part of the connector housing which is fixedly connected to the connector housing on one side and comprises at least one free end which is free to move in directions essentially parallel to the insertion direction and sideways to the insertion direction, wherein the safety spring bar is formed of the same material as the connector housing.

* * * * *